US005354650A

United States Patent [19]

Southby et al.

[11] Patent Number: 5,354,650

[45] Date of Patent: Oct. 11, 1994

[54] PHOTOGRAPHIC ELEMENTS CONTAINING RELEASE COMPOUNDS

[75] Inventors: David T. Southby; Daniel L. Kapp; Wojciech Slusarek; Louis E. Friedrich, all of Rochester; Zbyslaw R. Owczarczyk; Xiqiang Yang, both of Webster, all of N.Y.

[73] Assignee: Eastman Kodak Company, Rochester, N.Y.

[21] Appl. No.: 148,805

[22] Filed: Nov. 5, 1993

Related U.S. Application Data

[63] Continuation-in-part of Ser. No. 890,905, May 29, 1992, abandoned.

[51] Int. Cl.[5] ..... G03C 5/54; G03C 7/32

[52] U.S. Cl. ..... 430/544; 430/202; 430/222; 430/223; 430/226; 430/955; 430/957; 430/958; 430/959; 430/564; 430/557

[58] Field of Search ..... 430/202, 222, 223, 226, 430/544, 955, 957, 958, 959, 564, 557

[56] References Cited

U.S. PATENT DOCUMENTS

| | | | |
|---|---|---|---|
| 3,880,658 | 4/1975 | Lestina | 430/226 |
| 4,234,672 | 11/1980 | Ford et al. | 430/222 |
| 4,248,962 | 2/1981 | Lau | 430/382 |
| 4,263,393 | 4/1981 | Chen | 430/218 |
| 4,310,612 | 1/1982 | Mooberry et al. | 430/223 |
| 4,343,893 | 8/1982 | Donald et al. | 430/401 |
| 4,358,525 | 11/1982 | Mooberry et al. | 430/217 |
| 4,409,323 | 10/1983 | Sato et al. | 430/544 |
| 4,537,853 | 8/1985 | Van de Sande et al. | 430/218 |
| 4,629,683 | 12/1986 | Itoh et al. | 430/955 |
| 4,684,604 | 8/1987 | Harder | 430/375 |
| 4,690,885 | 9/1987 | Yagihata et al. | 430/212 |
| 4,734,353 | 3/1988 | Ono et al. | 430/955 |
| 5,019,492 | 5/1991 | Buchanan et al. | 430/543 |
| 5,034,311 | 7/1991 | Slusarek et al. | 430/544 |
| 5,055,385 | 10/1991 | Slusarek et al. | 430/544 |
| 5,116,712 | 5/1992 | Matsushita et al. | 430/958 |
| 5,242,783 | 9/1993 | Buchanan et al. | 430/446 |

FOREIGN PATENT DOCUMENTS

| | | | |
|---|---|---|---|
| 0335319 | 10/1989 | European Pat. Off. . | |
| 0167168 | 11/1989 | European Pat. Off. . | |
| 3506805 | 9/1985 | Fed. Rep. of Germany . | |
| 3153236A | 7/1991 | Japan | G03C 1/06 |
| 2036994 | 10/1978 | United Kingdom | G03C 1/07 |

*Primary Examiner*—Richard Schilling
*Attorney, Agent, or Firm*—Peter C. Cody

[57] ABSTRACT

Photographic elements are described which contain a release compound that during photographic processing provides an imagewise distribution of a photographically inert compound which can react with a uniform distribution of a second compound contained in the element to form a photographically active compound.

13 Claims, No Drawings

PHOTOGRAPHIC ELEMENTS CONTAINING RELEASE COMPOUNDS

CROSS-REFERENCE TO RELATED APPLICATION

This is a continuation-in-part of Ser. No. 07/890,905 filed May 29, 1992 which is incorporated herein by reference.

FIELD OF THE INVENTION

This invention relates to silver halide photographic elements containing release compounds and to processes of forming images in such photographic elements. In particular, it relates to elements and processes in which the release compound provides an imagewise distribution of a photographically inert compound which can interact with a distribution of a second compound contained in the element to form a photographically active compound.

BACKGROUND OF THE INVENTION

Images are formed in silver halide color photographic materials by reaction between oxidized silver halide developing agent and a dye forming compound known as a coupler. It has become common practice to modify the photographic properties of the image, such as sharpness, granularity, contrast and color reproduction, by the use of an image modifying compound commonly referred to as a development inhibitor releasing (DIR) compound. Such materials were first described in U.S. Pat. Nos. 3,148,062 and 3,227,554.

In addition to development inhibitors, other photographically active groups may desirably be released during photographic processing. Such groups include development accelerators, bleach accelerators, bleach inhibitors, complexing agents, toners, stabilizers, etc.

Photograpically active groups typically are released during the development step in an imagewise manner. On occasion, depending upon the particular photographically active group and the purpose it is to serve, it may be desired to make available the active form of the photographically active group at a stage in the processing of the photographic element other than the development step, or in a uniform manner, or both.

Many release compounds release the photographically active group directly in its active form. This limits the use of such compounds in those situations where it is desired that the photographically active group act at a location remote from that where it is released. This is alleviated somewhat by release compounds in which the photographically active group is blocked by and released from an intervening group, commonly called a timing group, after that group is released from the carrier portion of the compound. Compounds of this type are described in U.S. Pat. Nos. 4,248,962; 4,409,323; 4,684,604; 5,034,311 and 5,055,385 and in European Patent Application 0 167 168.

The use of a timing group that blocks the active function of the photographically active group permits the photographically active group to diffuse away from the site where it is initially released before it is made available in the active form by removal of the blocking group. However, this still does not provide complete control over the location where the photographically active group acts. The use in a photographic element of a compound having a photographically active group in which the active site is blocked is known. For example, U.S. Pat. Nos. 4,343,893 and 4,690,885, and European Published Patent Application 0 335 319 show such compounds. However, in this type of compound the blocking group is removed during processing in a non-imagewise fashion. Thus, there is no correlation between release and imaging.

German Published Patent Application DT OS 35 06 805 describes the release of a photographically active group during photographic processing followed by modification of the photographic effect of that group by another compound released during processing, either to strengthen or weaken the effect of the originally released photographically active group. The active site of the photographically active group is present upon original release. The mechanisms and reactions which are described in this patent application for the release of photographically active groups are substantially different from those employed in the present invention.

It would be desirable to provide photographic elements in which a photographically active group is made available in its active form only after it has interacted with another component of the element, so that the operation of the photographically active group is a function of the presence of the other component. This would provide more control over the location where the photograpically active group acts.

SUMMARY OF THE INVENTION

In accordance with the present invention, there is provided a photographic element comprising a support bearing at least one silver halide emulsion layer, the element containing:

a) a release compound that provides, as a function of development, an imagewise distribution of a compound A that is photographically inert in the form in which it is released; and b) a uniform distribution in at least one of the layers of the element of a compound B, or a precursor of compound B that under photographic processing conditions provides a uniform distribution of compound B, both compound B and its precursor being photographically inert in the form in which it is contained in the layer;

compounds A and B being such that, under photographic processing conditions, they interact to provide a photographically active group.

By employing compounds A and B, which need to interact in order for the photographically active group to be available in its active form, it is possible to target the location where that group operates. This permits the fine tuning of the way that such a group is made available in the layers of a photographic element. This also provides a means for incorporating and making available in a photographic element the precursors of a photographically active group that would otherwise be unstable.

DETAILED DESCRIPTION

The compounds A and B can be located in the same layer or in separate layers. If the compounds are in the same layer, it is possible to make available photographically active groups for which stable release compounds are not available. If the compounds are in the same layer, it is also possible to optimize the effect of the photographically active group while minimizing its effect on adjacent layers. If the compounds A and B are located in different layers, it is also possible to assure that the photographically active group is not available in its active form until the released moiety has migrated out of the layer in which it is coated. Depending upon the particular photographically active group which is employed, one or the other of these configurations would be preferred. Similarly, depending upon the photographically active group and compounds A and B, it may be desirable to have one of compounds A and B in a layer free of silver halide.

The photographically active group formed by interaction between compounds A and B, can be any of the groups usefully made available in photographic elements other than dyes. These include development accelerators, development inhibitors, bleach accelerators, bleach inhibitors, developing agents (e.g. competing developing agents or auxiliary developing agents), silver complexing agents, fixing agents, toners, hardeners, tanning agents, fogging agents, antifoggants, antistain agents, and stabilizers.

This can be accomplished by the choice of the particular carrier group from which the compound A or B is released. In a preferred embodiment, the photographically active group is made available in an imagewise manner. In a particularly preferred embodiment, the photographically active group is a development inhibitor, a development accelerator or a bleach accelerator.

As used herein, the term "photographically inert" means that the compounds A and B (or their precursors) do not individually provide, to any significant extent, a desired photographic effect prior to their interaction. The desired photographic effect is that which the photographically active group provided by interaction of compounds A and B is known for in the art. It is, however, possible that either or both of compounds A and B (or their precursors) have some photographic effect, other than the desired photographic effect. This other effect may be desired or not.

It is within the contemplation of this invention that both the compound A and the compound B are incorporated in the photographic element in a form which requires that they interact with a component of a processing solution before they are able to interact with each other to form a photographically active group. This interaction with a processing solution component can lead to different combinations of imagewise and uniform release of the compounds A and B.

In one embodiment compound A is released imagewise as a function of silver halide processing and compound B is released uniformly during processing in a form that will interact with the imagewise released compound to provide an imagewise distribution of the photographically active group.

In a preferred embodiment, compound A is released in an imagewise manner and compound B is present initially as a uniform distribution in a form in which it can interact with the imagewise released component so as to provide an imagewise distribution of the photographically active group. In this embodiment, it is particularly preferred that compound A, which is released, is the smaller, more mobile component, and that compound B, which is present as a uniform distribution, is relatively immobile. In this embodiment, it is particularly preferred that the two components are initially present in different layers which are so positioned relative to one another that the imagewise released component can migrate to the other component during processing.

One of the components can be a nucleophile or precursor of a nucleophile capable of undergoing an aromatic nucleophilic substitution reaction. Such nucleophiles are described in Chapter 13 of *Advanced Organic Chemistry,* Third Edition, J. March, published by John Wiley & Sons (1985). They include oxygen nucleophiles (alkoxide and aryloxide) and nitrogen nucleophiles (amines, azides), preferably those other than oximes; halide nucleophiles (iodide, bromide, chloride, fluoride, fluoroborate); carbon nucleophiles (cyanide, acetylide); and sulfur nucleophiles (thiols, thiocyanate, disulfide anion, and sulfinates). Preferred are aryl, alkyl and heterocyclic thiols which can be substituted with noninterfering groups such as alkyl, aryl, aralkyl, alkaryl, alkoxy, aryloxy, sulfono, amido, sulfonamido, carboxy, halo, nitro and the like.

Particularly preferred are thiol nucleophiles, such as the arylthiols represented by the structural formulas:

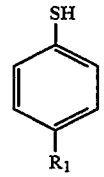

$R_1$ is $CH_3$—, $CH_3(CH_2)_5$—, Cl, or $CH_3(CH_2)_6O$—

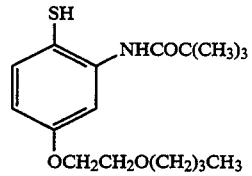

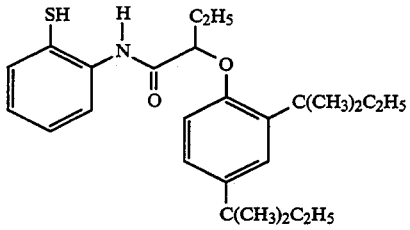

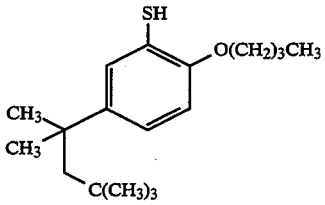

The nucleophile can be coated as a uniform distribution in a layer of the photographic element, but preferably is part of a release compound and only made available as a nucleophile during photographic processing. Suitable release compounds contain an immobile carrier group from which the remainder of the compound is released during photographic processing. When the nucleophile is the compound B, the carrier can be a blocking group formed from a silyl group or from a carboxylic, sulfonic, phosphonic, or phosphoric acid derivative, and which releases the nucleophile in a nonimagewise manner by reaction with a component of processing solution such as water or hydroxylamine. A preferred such blocking group is described in Buchanan et al. U.S. Pat. No. 5,019,492.

The carrier can be an oxidizable moiety, such as a hydrazide or hydroquinone derivative, which releases the nucleophile in an imagewise manner as a function of silver halide development. Such blocking groups are described, for example, in U.S. Pat. Nos. 3,379,529 and 4,684,604.

In a preferred embodiment the carrier is a coupler moiety to whose coupling position a nucleophile is attached, so that it is coupled off by reaction with oxidized color developing agent formed in an imagewise manner as a function of silver halide development. Particularly preferred are magenta dye forming couplers, such as pyrazolones and pyrazoloazoles, and couplers which form colorless reaction products.

In any of these embodiments, a timing group can be present between the carrier and the nucleophile. Suitable timing groups are described in U.S. Pat. Nos. 4,248,962; 4,409,323, 4,684,604, 5,034,311, and 5,055,385; and European Patent Application 0 167 168. Examples of release compounds with preferred timing groups from which a nucleophile can be made available are shown below, where CAR is a carrier from which the remainder of the molecule is released during photographic processing and X represents the nucleophile.

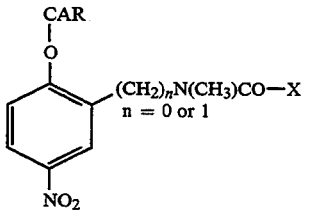

-continued

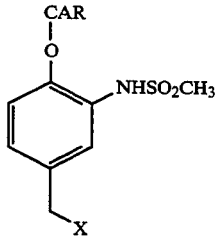

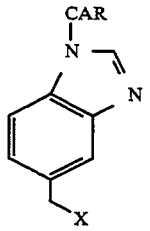

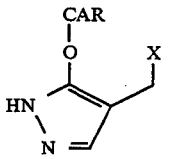

Examples of compounds that release a nucleophile, i.e. compound A, in an imagewise fashion include:

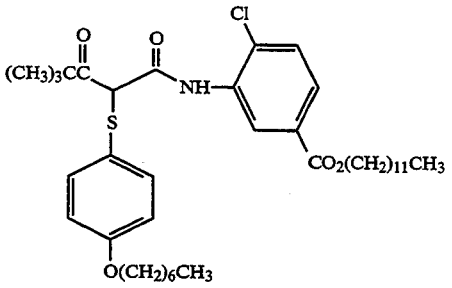

A-1

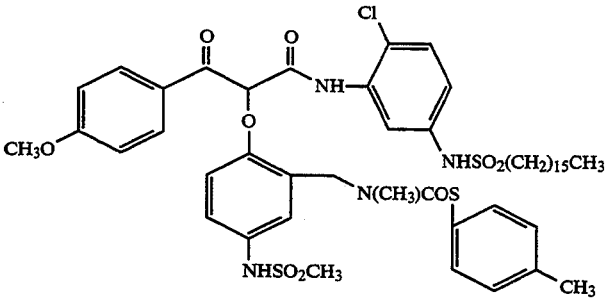

A-2

-continued
A-3
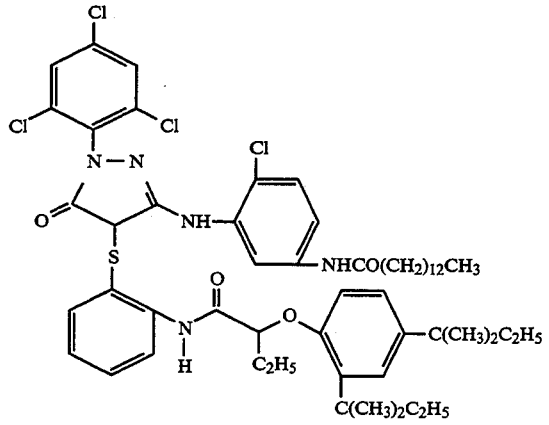
A-4
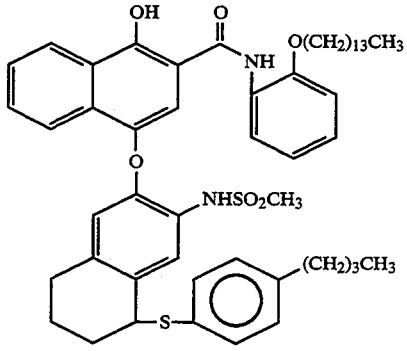
A-5
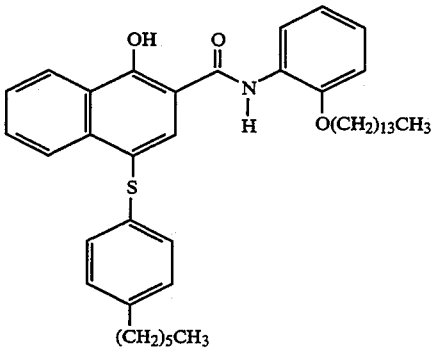
A-6
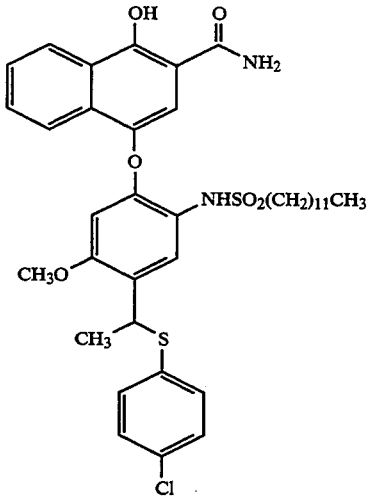

-continued
A-7
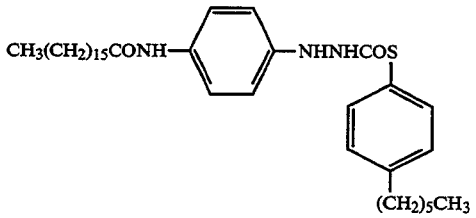
A-8
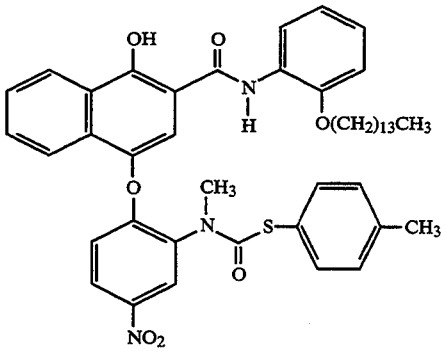
A-9
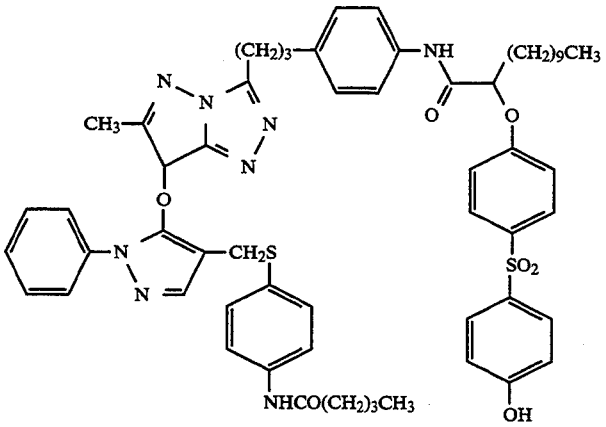
A-10
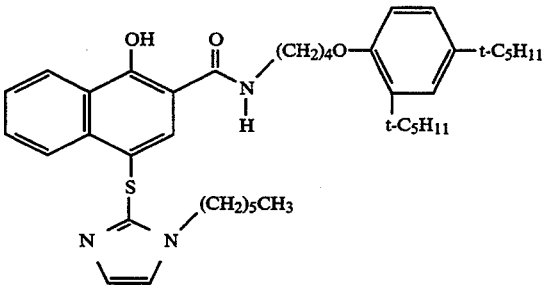

-continued
A-11
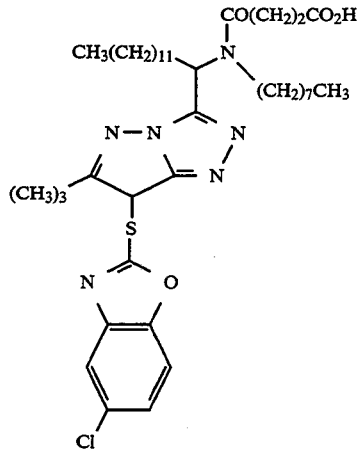
A-12
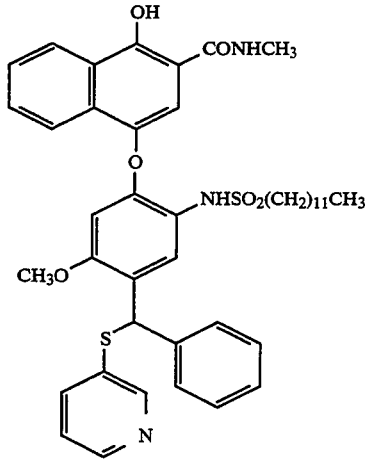
A-13
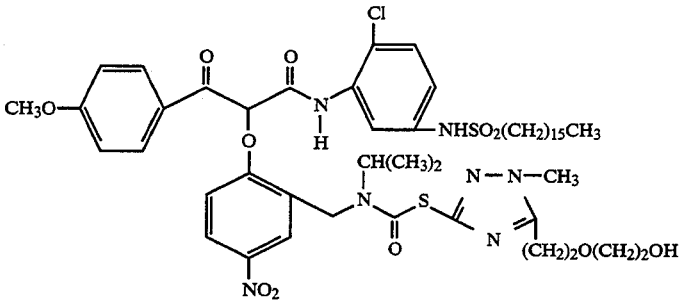
A-14
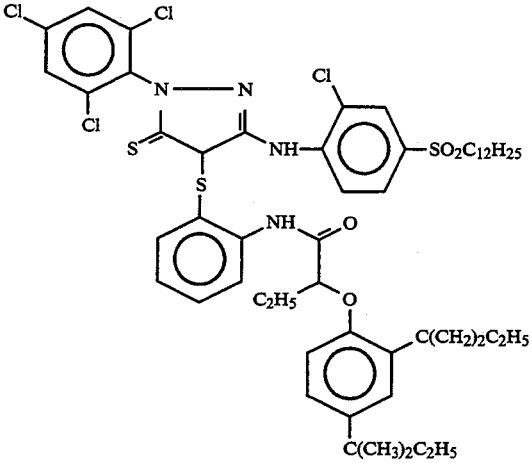

In a preferred embodiment of this invention, the nucleophile, released from the compound above, interacts with a photographically active group that has its active site blocked by a ballasted group in such a way that only in the presence of the nucleophile will the active site be unblocked. Examples of groups which are capable of undergoing an exchange reaction with nucleophiles are silylethers, disulfides, esters, amides, activated alkenes, and activated arenes.

Preferred compounds of this type, i.e. compound B, can be represented by the following structural formula:

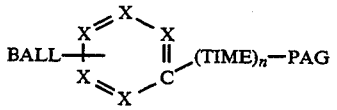

wherein:

X is N or C—R;

R is H or a monovalent substituent;

BALL is a ballast group which renders the compound immobile in the layer in which it is coated;

TIME is a timing group;

n is 0, 1 or 2; and

PAG is a photographically active group.

Other preferred compounds (B) of this type are represented by the structural formula:

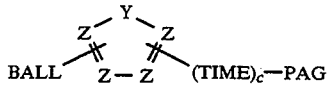

wherein:

Y is O, S, or N—R;

Z is N or C—R;

R is H or a monovalent substituent;

BALL is a ballast group which renders the compound immobile in the layer in which it is coated;

TIME is a timing group;

n is 0, 1, or 2; and

PAG is a photographically useful group.

Suitable timing groups and photographically active groups have been described above by reference to U.S. patents and published applications, the disclosures of which are incorporated herein by reference.

Suitable R groups include hydrogen, halogen, alkyl, aryl, carboxy, amido, sulfonamido, nitro, cyano, fluoro, fluoroalkyl, fluorosulfonyl, sulfonamido, amino sulfonyl, alkylsulfonyl, aryl sulfonyl, alkylcarbonyl, arylcarbonyl, carboxyalkyl, carboxyaryl and the like.

Representative such compounds that are useful in this invention include the following:

B-1

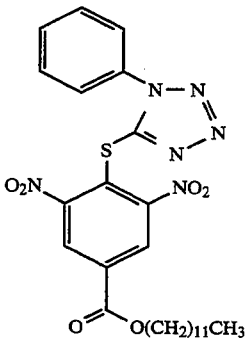

B-2

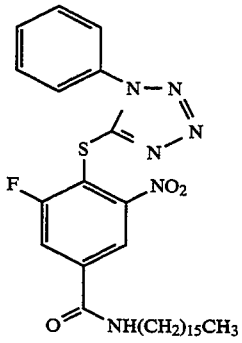

B-3

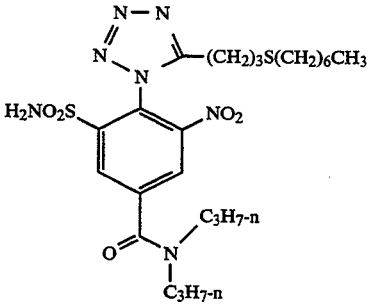

B-4

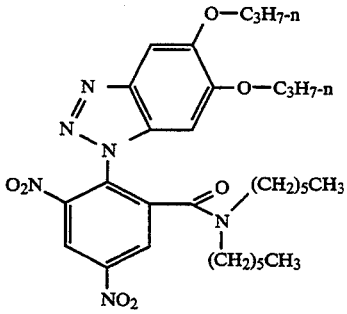

B-5

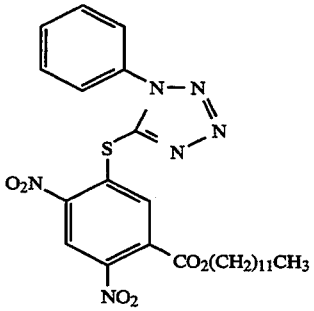

B-6

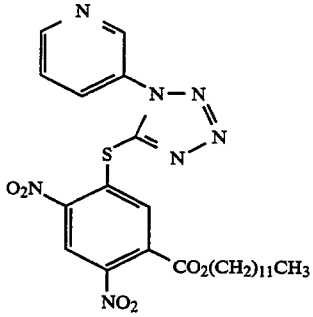

-continued
B-7
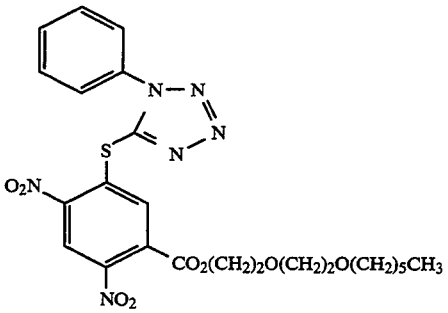
B-8
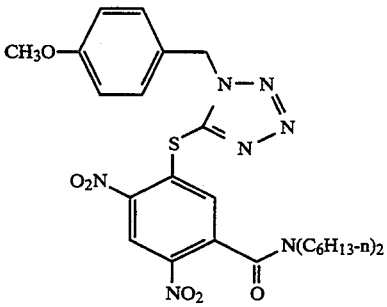
B-9
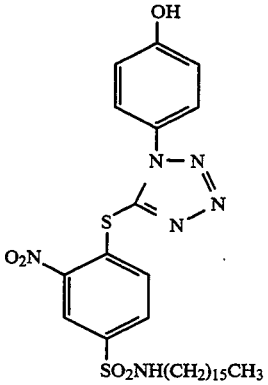
B-10
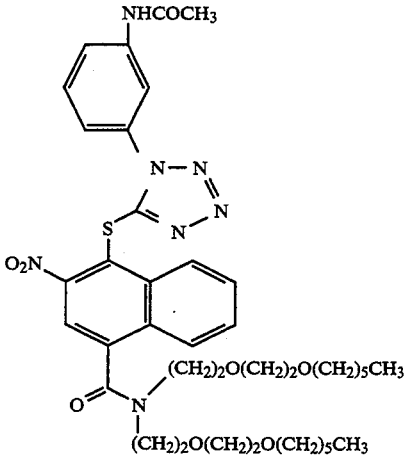
B-11
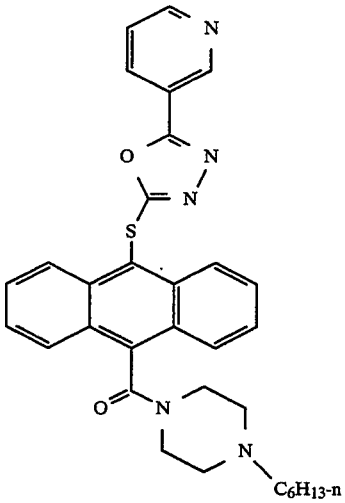
B-12
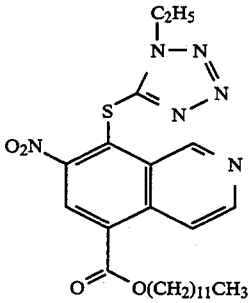
B-13
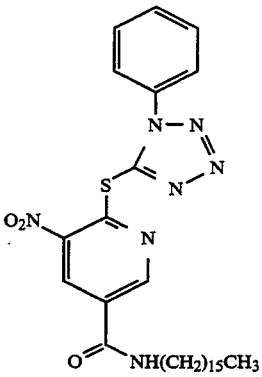
B-14
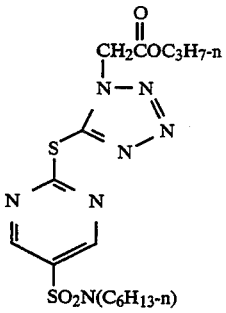

-continued
B-15
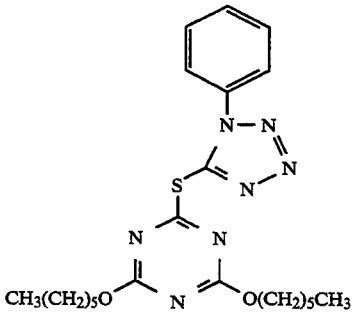
B-16
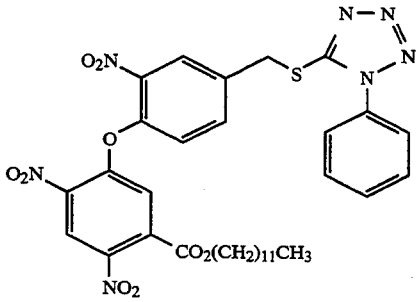
B-17
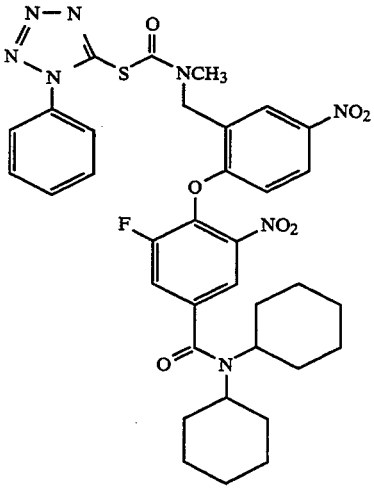
B-18
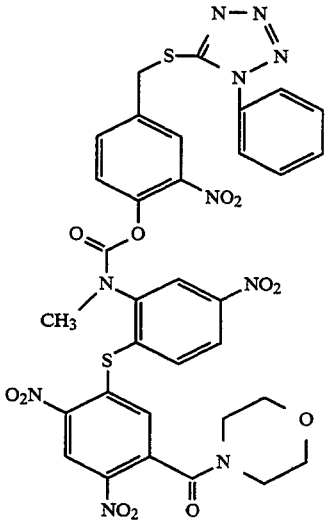
B-19
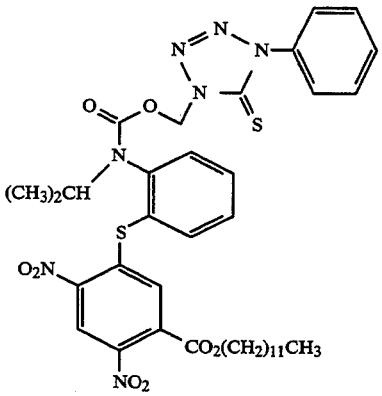
B-20
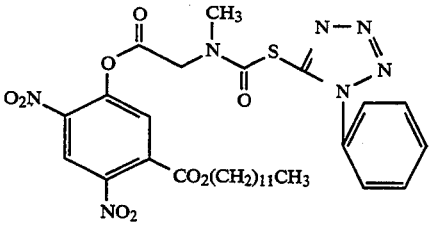
B-21
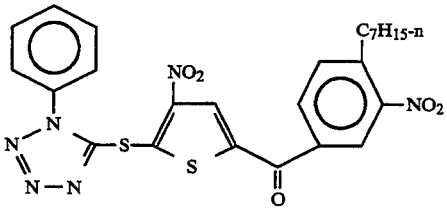
B-22
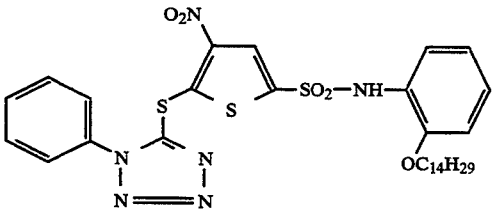

-continued
B-23
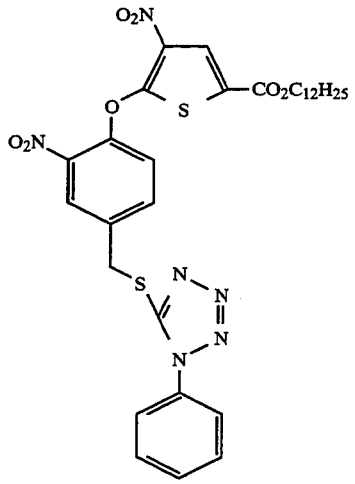
B-24
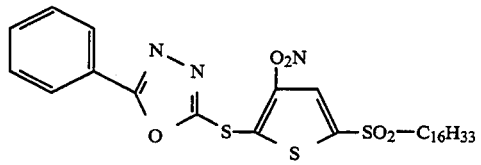
B-25
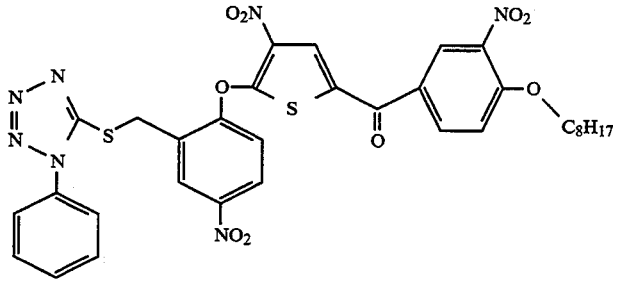
B-26
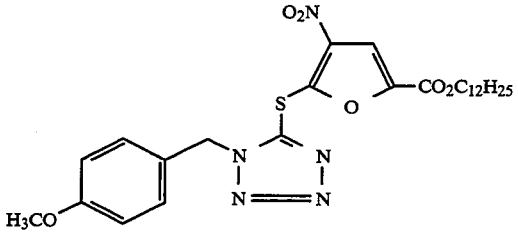
B-27
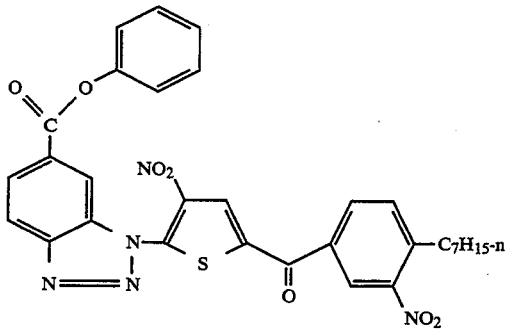
B-28
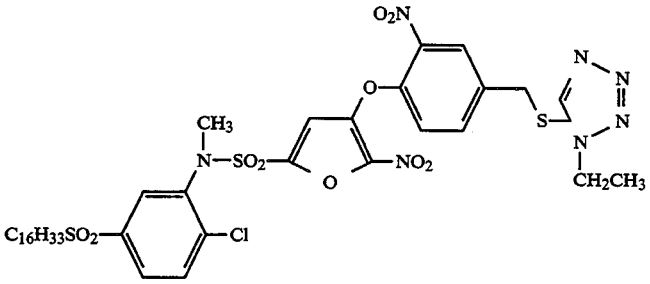

-continued
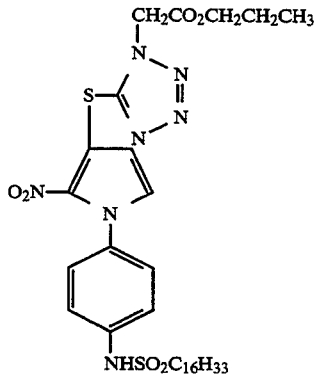
B-29
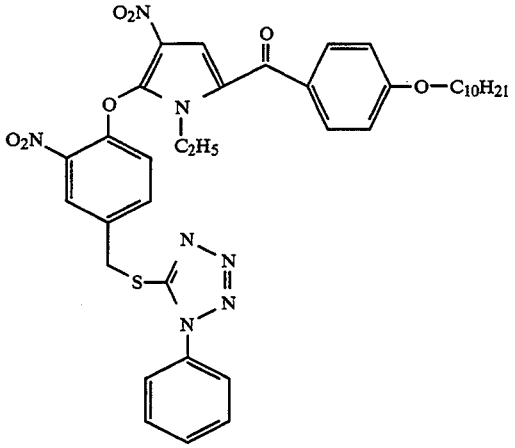
B-30
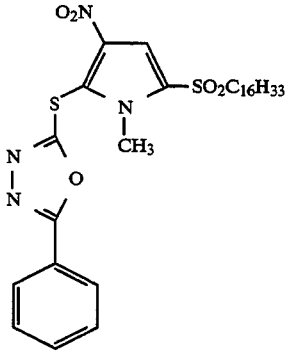
B-31
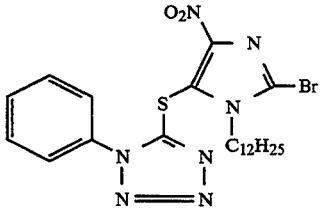
B-32
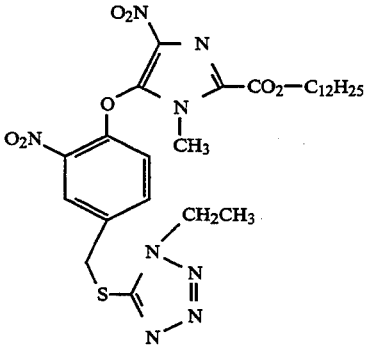
B-33
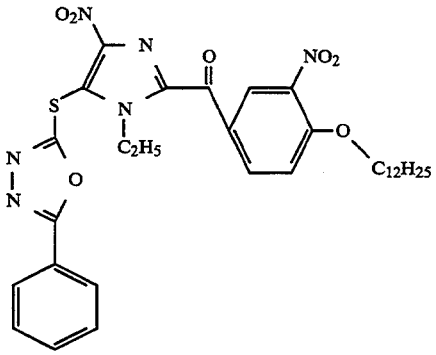
B-34
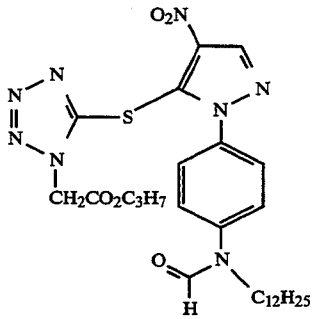
B-35
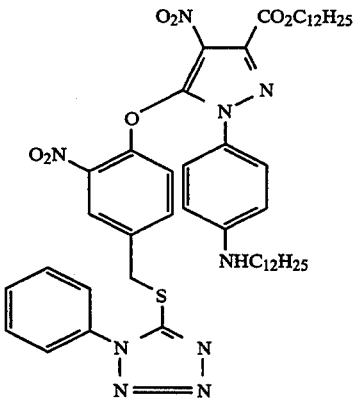
B-36

-continued
B-37
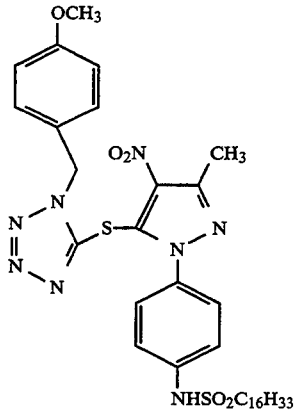
B-38
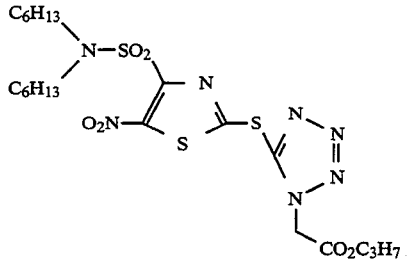
B-39
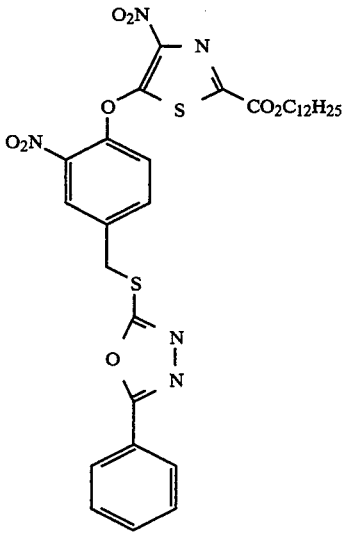
B-40
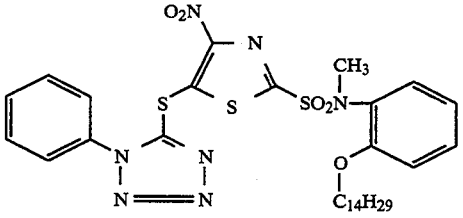
B-41
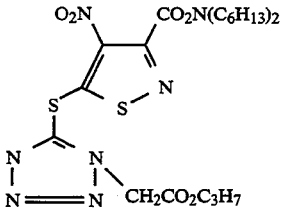
B-42
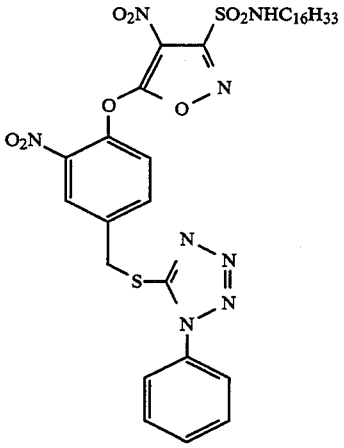
B-43
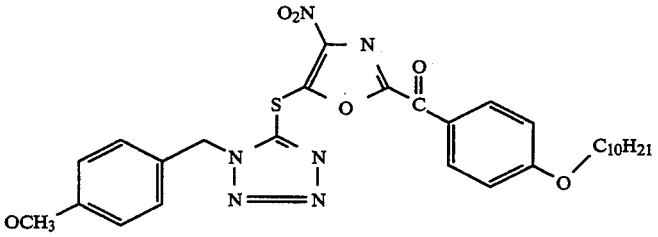

-continued
B-44
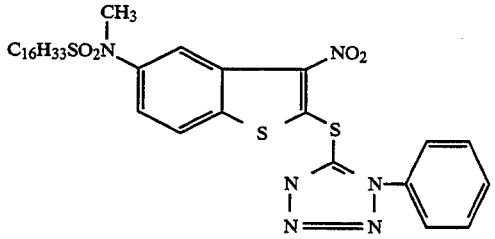
B-45
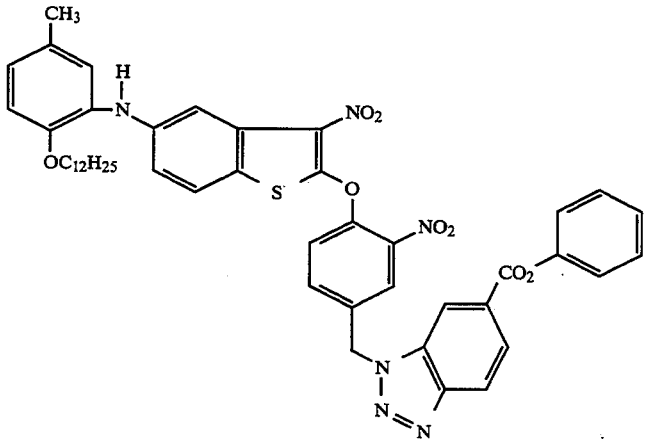
B-46
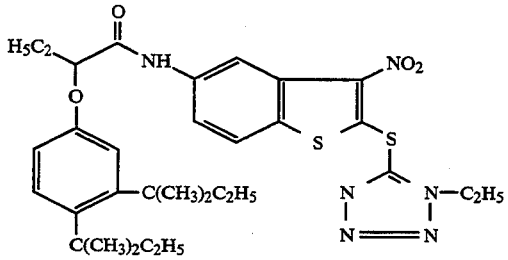
B-47
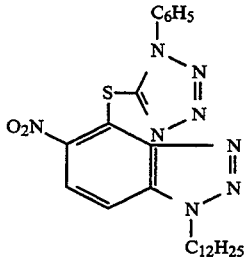
B-48
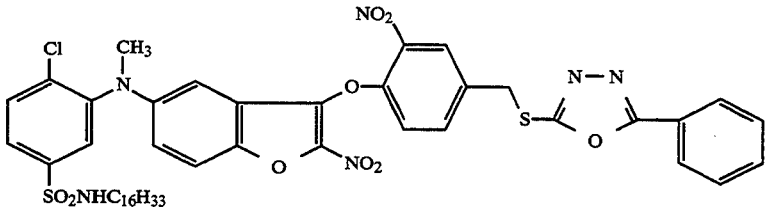
B-49
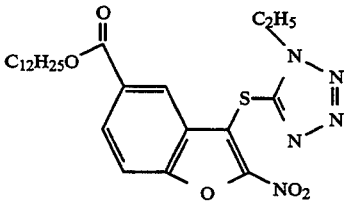
B-50
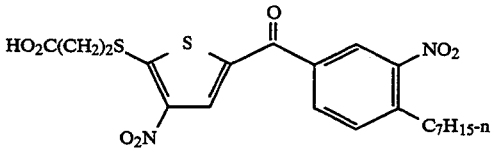
B-51
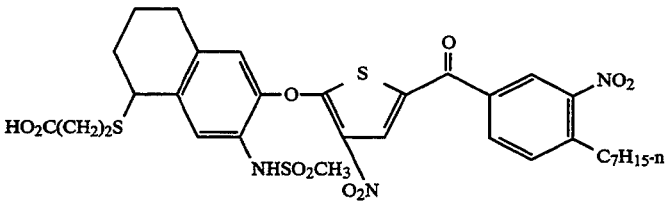
In the above collection of specific structures, the compounds designated as A release a mobile nucleophile and the compounds designated as B are blocked photographically active groups or precursors of blocked photographically active groups. It will be appreciated that the Compound A can be a blocked PUG that is released in an imagewise manner, but not unblocked, as a function of silver halide development and the Compound B can be a nucleophile which is present as a uniform distribution or can be released from a precursor in a uniform manner. Suitable such compounds are shown below.

Examples of compounds capable of releasing a blocked development inhibitor in an imagewise fashion include:

A-15

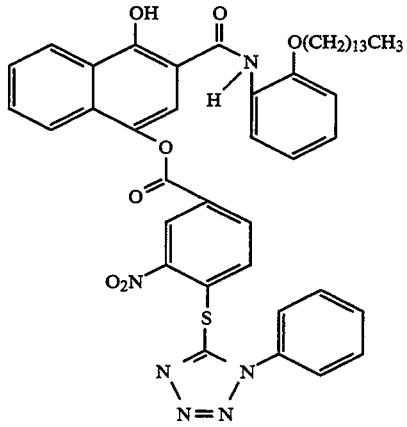

A-16

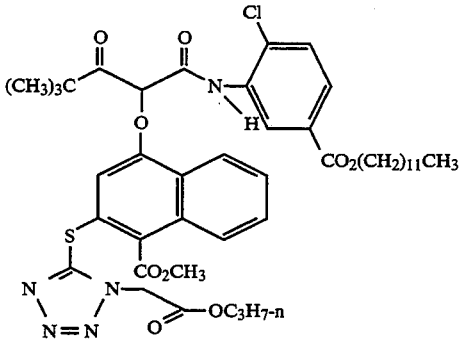

A-17

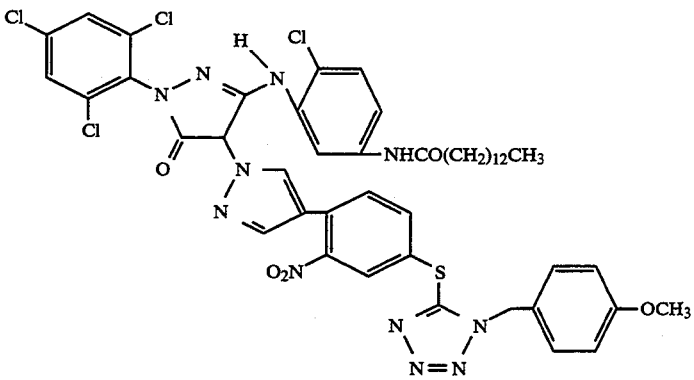

-continued

A-18

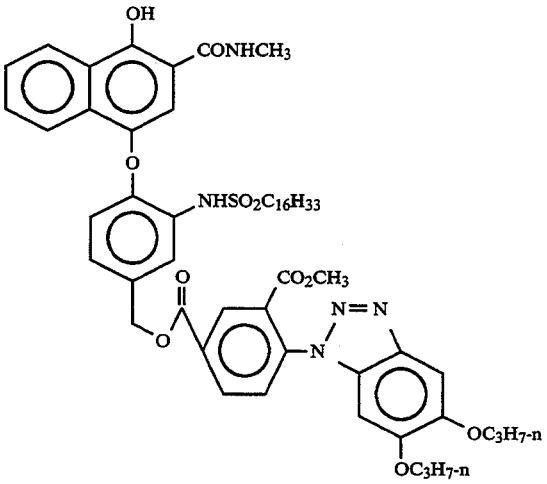

Examples of compounds or precursors thereof which are photographically inert and capable of deblocking a blocked development inhibitor include:

B-52

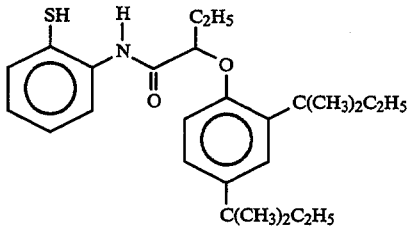

B-53

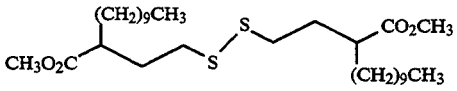

B-54

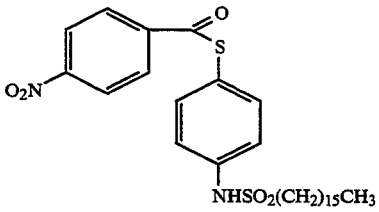

B-55

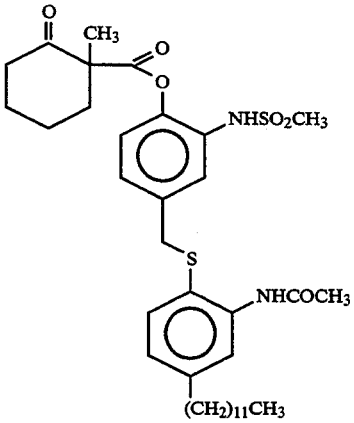

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The compounds A and B, or their precursors, can be contained in one or more of the layers of the element where they will be able to interact with one another during photographic processing.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section IX), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

The release compounds of this invention can be used to provide effects for which compounds which release photographically active groups have been used in the past. Reference will be made to exemplary ways in which preferred photographically active groups can be employed.

When the photographically active group is a development inhibitor, it can be employed in a photographic element as described, for example, in U.S. Pat. Nos. 3,227,554; 3,620,747; 3,703,375; 4,248,962 and 4,409,323. Compounds of this invention which provide a development inhibitor can be contained in, or in reactive association with, one or more of the silver halide emulsion units in a color photographic element. If the silver halide emulsion unit is composed of more than one layer, one or more of such layers can contain the compound of this invention. The layers can contain photographic couplers conventionally used in the art. If the carrier group in the compounds of this invention is a coupler, it can form dyes of the same color as the color forming coupler(s) in the layer or unit, it can form a dye of a different color, or it can result in a colorless or neutral reaction product. The range of operation of the development inhibitor between layers can be controlled by the use of scavenger layers, such as a layer of a fine grain silver halide emulsion. Scavenger layers can be in various locations in an element containing couplers of this invention. They can be located between layers, between the layers and the support, or over all of the layers.

When the photographically active group is a bleach inhibitor, it can be employed in the ways described in U.S. Pat. No. 3,705,801, to inhibit the bleaching of silver in selected areas of a photographic element.

When the photographically active group is a developing agent, it can be used to compete with the color forming developing agent, and thus reduce dye density.

Release compounds of this invention in which the photographically active group is a nucleating agent can be used to accelerate development, and when it is a bleach accelerator it can be used to accelerate bleaching in a subsequent processing step.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The release and/or unblocking of compounds A and B generally is expected to occur during the development step. However, it is within the contemplation of our invention that release and/or unblocking occur during another processing step, if it is desired that the photographically active group not be made available until that step.

Examples

The following Examples further illustrate the synthesis of compounds useful in the invention.

Preparative Example 1–Preparation of Compound (B-5)

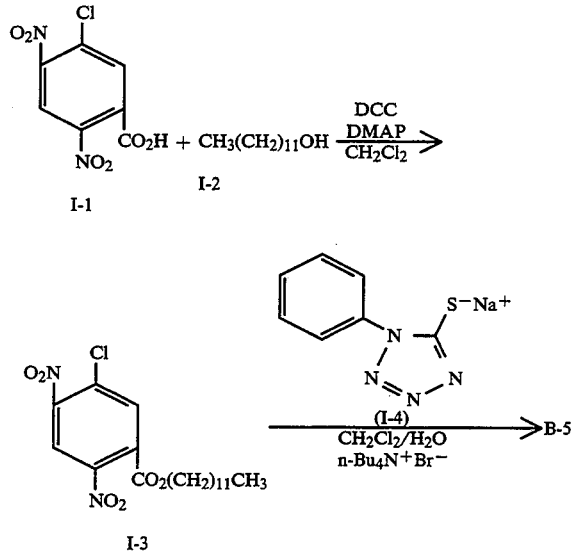

DCC — Dicyclohexylcarbodiimide
DMAP — 4-(N,N-dimethylamino)pyridine

Preparation of Compound I-3

A mixture of 3-chloro-4,6-dinitrobenzoic acid (I-1; H. Goldstein and R. Stamin, Helv. Chim. Acta, 35, 1330 (1952))(12.33 g); 50 mmole), dodecanol (I-2) (9.3 g; 50 mmole) and dimethylaminopyridine (DMAP) (0.61 g; mmole) stirred in 100 ml of dichloromethane at 0° C. was treated in drops with a solution of DCC (11.35 g; 55 mmole) in 25 ml of dichloromethane over a period of 30 min. The mixture was then stirred at room temperature for 1.5 h and filtered. The filtrate was concentrated and the crude product purified by chromatography on silica gel. Yield 10.4 g (25 mmole; 50%)

Preparation of Compound (B-5)

A mixture of I-3 (6.23 g; 15 mmole), sodium 1-phenyl-1H-tetrazole-5-thiolate (I-4) (4.00 g; 20 mmole) and tetra-n-butylammonium bromide (0.21 g; 0.65 mole) in 100 ml of water/dichloromethane (1:1) was stirred at room temperature for 30 min. The organic solution was then separated, dried over magnesium sulfate, concentrated and the crude product was purified by silica gel chromatography. Yield 6.5 g (12 mmole; 78%).

Calculated for $C_{26}H_{32}N_6O_6S$: % C—55.58 % H—6.50 % N—6.64 % Cl—8.5

Found: % C—55.01% H—6.56 % N—6.75 % Cl—8.55

Preparative Example 2

Preparation of Compound (B-6)

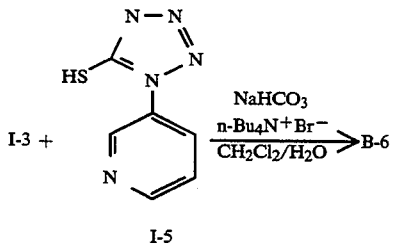

A mixture of 1-(3-pyridyl)-1H-tetrazole-5-thiol (I-5) (5.37 g; 30 mmole), I-3 (12.45 g; 30 mmole), sodium bicarbonate (3.36 g; 40 mmole), and tetra-n-butylammonium bromide (1 g) in 200 ml of water/dichloromethane was stirred at room temperature for 24 h. Worked up as described in Example 1. Yield 14.44 g (26 mmole; 86%).

Preparative Example 3—Preparation of Compound. (B-7)

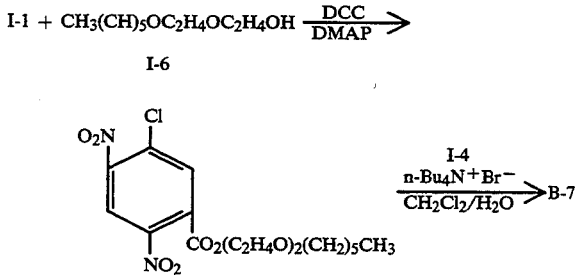

Preparation of Compound I-7

A mixture of 3-chloro-4,6-dinitrobenzoic acid (I-1) (12.33 g; 50 mmole), 2-(2-hexyloxyethoxy) ethanol (I-6) (9.51 g; 50 mmole), and DMAP (0.61 g; 5 mmole) stirred in 100 ml of dichloromethane at 0° C. was treated in drops with a solution of DCC (11.35 g; 55 mmole) in ml of dichloromethane. The mixture was stirred at room temperature for 2 h and then worked up as described in Example 1. Yield 17.0 g (41 mmole; 81%).

Preparation of Compound (B-7)

A mixture of I-7 (17.0 g; 41 mmole), I-4 (10.0 g; 50 mmole), and tetra-n-butylammonium bromide (0.64 g; 2 mmole) in 200 ml of dichloromethane/water (1:1) was stirred at room temperature for 2 h and worked up as described in Example 1. Yield 17.2 g (31 mmole; 75%), mp 55°-56° C.

Preparative Example 4—preparation of Compound (A-5)

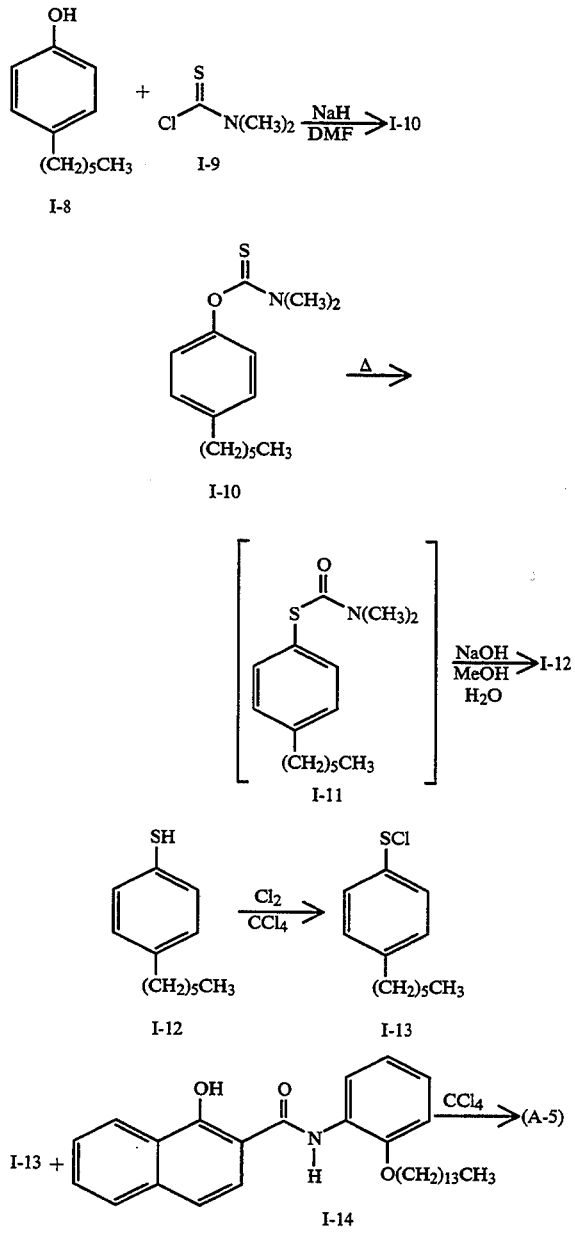

Preparation of Compound I-10

A solution of I-8 (17.8 g; 100 mole) in 50 ml of dimethylformamide was added over a period of 45 min at 0° C. to a slurry of 60% sodium hydride (4.0 g; 100 mmole) in 50 ml of dimethylformamide. The mixture was stirred for 30 min. and then treated in drops with a solution of I-9 (21.0 g; 170 mmole) in 40 ml of dimethylformamide. After 20 h at room temperature, the reaction mixture was worked up with water and toluene. The crude product was purified by silica gel chromatography giving 18.2 g of 1-10 (69 mole; 69%).

Preparation of Compound I-12

A flask containing 17.8 g (67 mole) of 1-10 was kept at 315° C. for 1 h. After cooling to room temperature, the crude 1-11 was dissolved in 150 ml of methanol and 50 ml of 10% aqueous sodium hydroxide. The solution was refluxed for 2 h, cooled to room temperature and worked up with ice/conc HCl/ethyl acetate. The crude product was distilled to give 9.25 g (48 mole; 71%) of I-12, b.p. 145°-156° C./20 Torr.

Preparation of Compound I-13

A solution of I-12 (3.32 g; 17 mmole) in 25 ml of carbon tetrachloride was added over a period of 1 h to a solution of chlorine (63 g; 0.89 mole) in 100 ml of carbon tetrachloride at −10° C. The solvent was distilled off giving 3.95 g of crude product I-13 (17 mole; 100%).

Preparation of Compound (A-5)

A solution of I-13 (3.95 g; 17 mmole) in 20 ml of carbon tetrachloride was added over a period of 15 min at room temperature to a solution of 1-14 (7.17 g; 15 mmole). The reaction mixture was stirred for 20 h, diluted with ligroin (50 ml) and taken to dryness. The crude product was washed with methanol and recrystallized from acetonitrile. Yield 8.73 g (13 mmole; 87%).

Calculated for $C_{43}H_{57}NO_3S$: % C—77.32 % H—8.60 % N—2.10

Found: % C—77.67 % H—8.53 % N—2.06

Preparative Example 5—Preparation of Compound (A-8)

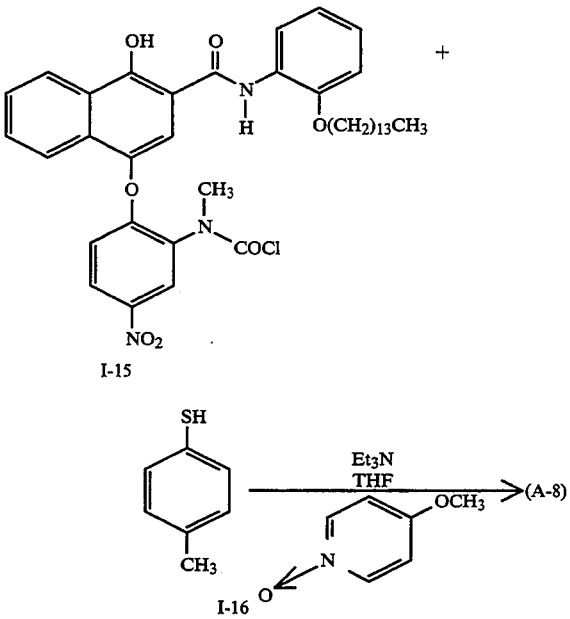

Neat triethylamine (1.21 g; 12 mmole) was added in one portion at room temperature to a solution of I-15 (7.04 g; 10 mmole), p-toluenethiol (I-16) (1.49 g; 12 mmole), and 4-methoxypyridine N-oxide (0.1 g) in 75 ml of tetrahydrofuran. The mixture was stirred for 20 h and then filtered. The filtrate was purified by silica gel chromatography giving 4.77 g (6 mmole; 60% of product (A-8)).

Calculated for $C_{46}H_{53}N_3O_7S$: % C—69.76 % H—6.75 % N—5.31 % S—4.05

Found: % C—69.69 % H—6.76 % N—5.41 % S—4.02

Preparative Example 6—Preparation of Compound (B-21)

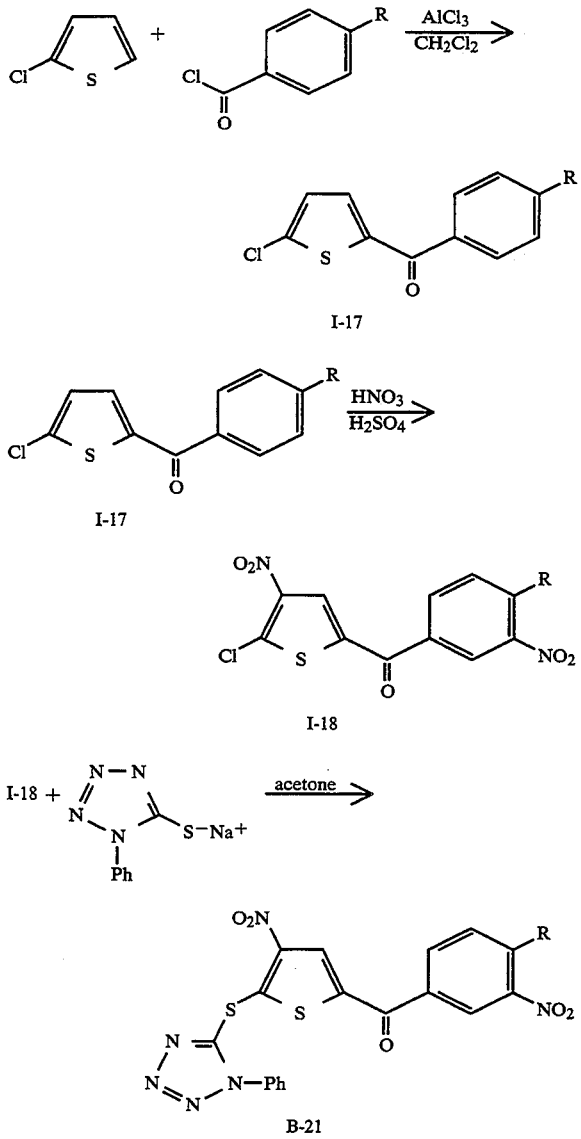

Preparation of Compound I-17

Para-n-heptylbenzoyl chloride (13.5 mL, 60 mmol) was added to a stirred suspension of aluminum chloride in methylene chloride (70 mmoles) (9.5 g, 70 mmol) at ca. 5° C. After being stirred for 20 min. the solution was treated with 2-chlorothiophene (5.5 mL, 60 mmol), while temperature was kept below 20° C. The reaction mixture was held at room temperature for an additional 1 hour and then poured into ice-water and separated prior to drying and concentrating. The crude product I-17 was obtained as a yellow oil (15.9 g, 82%).

Preparation of Compound I-18

Fuming nitric acid (90%)(2.2 mL) was added to a solution of compound I-17 (8.0 g, 25 mmol) in sulfuric acid (97%) at ca. −5° C. The reaction mixture was stirred at 0° C. for 30 min. and poured onto crushed ice. After 2 hours, solid was filtered off and washed successively with water, heptane, and 70% methanol; and dried to give 9.2 g (83%) of compound I-18 as an orange solid.

Preparation of Compound B-21

Compound I-18 (1.78 g, 4.0 mmol) in acetone (3 mL) was added to a mixture of 1-phenyl-1H-tetrazole-5-thiol sodium salt (0.84 g, 4.2 mmol) and acetone (10 mL), at a temperature below 20° C. After being stirred for 1 hour at room temperature, the mixture was poured on water; the solid filtered off; washed with 5% $K_2CO_3$ and water; and dried to give 1.98 g (85%) of the compound B-21 as a creamy solid.

The following Examples further illustrate the practice of the invention.

Example 1

Photographic elements were prepared by coating the following layers on a cellulose ester film support (the number following a component indicates the amount of the component contained in the layer, in mg/m$^2$).

Emulsion Layer 1: Gelatin—2690; Green sensitized silver. bromoiodide (as Ag)—1615; Cyan image coupler dispersed in dibutylphthalate—769; Compounds of Table 1 dispersed in diethyl lauramide Protective Overcoat: Gelatin—5380; Bisvinylsulfonylmethyl ether at 1.75% total gelatin.

Strips of each element were exposed to green and red light through a graduated density step tablet, or to green light through a 35% modulation fringe chart for sharpness measurements, and then developed for 3.25 minutes at 38° C. in the following color developer, stopped, washed, bleached, fixed, washed and dried.

| Color Developer: | |
|---|---|
| Distilled water | 800 ml |
| Sodium Metabisulfite | 2.78 g |
| Sodium Sulfite, anhydrous | 0.38 g |
| CD-4 (color developer)* | 4.52 g |
| Potassium Carbonate, anhyd. | 34.3 g |
| Potassium Bicarbonate | 2.32 g |
| Sodium Bromide | 1.31 g |
| Potassium Iodide | 1.20 mg |
| Hydroxylamine Sulfate (HAS) | 2.41 g |
| Diethylenetriaminepentacetic acid, pentasodium salt (40% Soln.) | 8.43 g |
| Distilled water | to 1 L |
| Adjust pH to 10.0. | |

*CD-4 is 4-amino-3-methyl-N-ethyl-N-beta-hydroxy-ethylaniline sulfate.

Processed images were read with red light to determine contrast and AMT acutance. Contrast ratio was defined as the contrast of the coating divided by the contrast of the coating with only image coupler. AMT calculations employed the following formula in which the cascaded area under the system modulation curve is shown in equation (21.104) on page 629 of *The Theory of the Photographic Process*, 4th Edition, 1977, edited by T. H. James: AMT=100+66 Log [cascaded area/2.669 M] wherein the magnification factor M is 3.8 for the 35 mm system AMT.

The results shown in Table I demonstrate the activation of a development inhibitor through the interaction of a released compound with a second compound uniformly distributed within a photographic layer. Individually, neither compound A-5 nor compound B-7 gave a substantial photographic effect. The combination of compounds A-5 and B-7 gave a reduction in contrast ratio and an increase in AMT accutance greater than that obtained with a known development inhibitor releasing coupler, Compound 1.

TABLE I

| Element | Compound(mmoles/m$^2$) | Contrast Ratio | AMT |
|---|---|---|---|
| Control | None | 1.00 | 90.9 |
| Comparison | A-5 (0.11) | 1.09 | 91.4 |
| Comparison | B-7 (0.54) | 0.90 | 91.5 |
| Invention | A-5 (0.11) + B-7 (0.54) | 0.38 | 95.0 |
| Comparison | 1 (0.05) | 0.45 | 94.4 |

Compound A-5

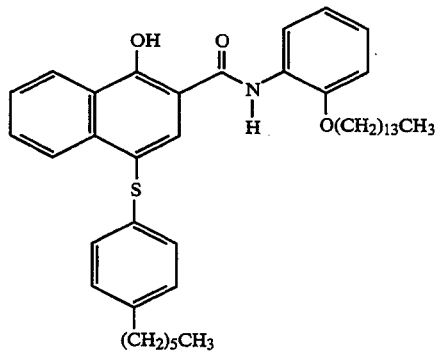

Compound B-7

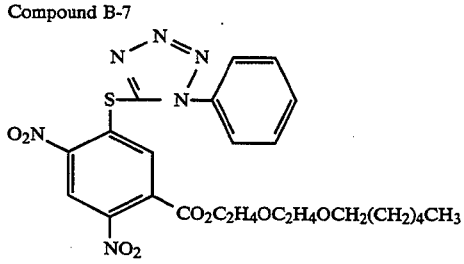

Compound 1

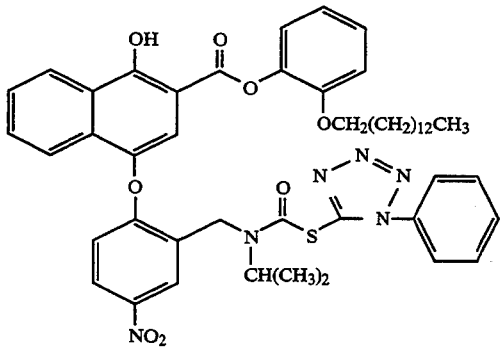

Example 2

A photographic element was prepared by coating the following layers on a cellulose ester film support (amounts of each component are indicated in mg/m$^2$).

Emulsion Layer 1: Gelatin—2420; Red sensitized silver bromoiodide (as Ag)—1615; Yellow image coupler dispersed in dibutyl phthalate—1290

Interlayer: Gelatin—860; Didodecyl hydroquinone—113

Emulsion Layer 2: Gelatin—2690; Green sensitized silver bromoiodide (as Ag)—1615; Magenta image coupler A-3 dispersed in a mixture of solvents A and B—491; Compound of Table II. (Compound B-5 was codispersed with the magenta image coupler).

Protective Overcoat: Gelatin 5380; Bisvinylsulfonylmethyl ether at 1.75% total gelatin The strips were exposed and processed as given in Example 1.

The data in Table II show that the released nucleophile from magenta image coupler A-3 provides a development inhibitor by interaction with a compound B-5. The addition of compound B-5 gave a reduction in contrast ratio relative to the control, and greater AMT acutance than the addition of compound 2.

TABLE II

| Compound(mmoles/m$^2$) | Contrast Ratio | AMT |
|---|---|---|
| None | 1.00 | 90.3 |
| B-5 (0.22) | 0.64 | 94.5 |
| 2 (0.05) | 0.61 | 92.8 |

Compound B-5

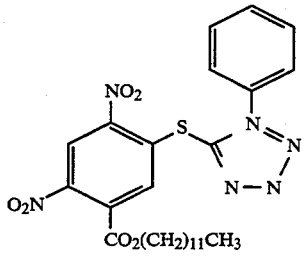

Compound 2

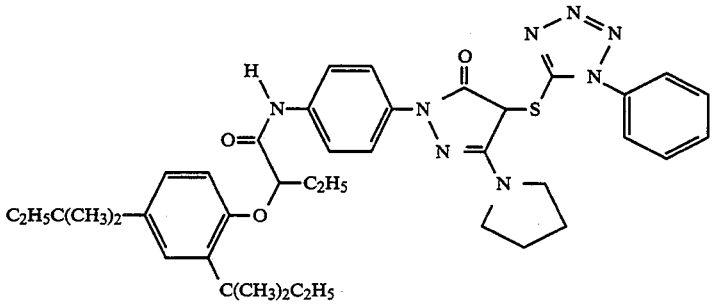

Image Couplers

Cyan

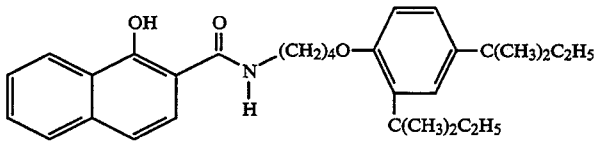

Yellow

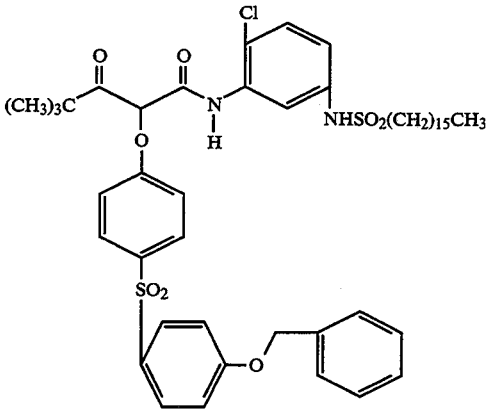

Solvent A: Tritolyl Phosphate

Solvent B:

TABLE II-continued

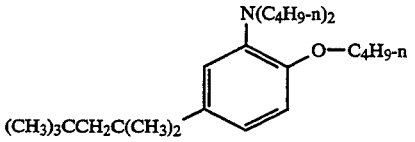

Example 3

A photographic element was prepared by coating the following layers on a cellulose ester film support (amounts of each component are indicated in mg/sq.m).

Emulsion Layer 1: Gelatin—3770; Green sensitized silver bromoiodide (as Ag) - 1615; Magenta image coupler A-3 dispersed in a dibutyl dodecamide—491; Compound of Table III (Compound B-21 was codispersed with the image coupler).

Protective Overcoat: Gelatin—2690; Bisvinylsulfonylmethyl ether at 1.75% total gelatin.

Strips of each element were exposed to green light through a graduated density step tablet, and then processed as in Example 1.

Processed images were read with green light to determine contrast. Contrast ratio and AMT were defined as in Example 1.

The results in Table III demonstrate the activation of the development inhibitor through the interaction of the nucleophile released from the image coupler A-3 with the inventive compound B-21. The comparison compound 2 releases the same development inhibitor through a coupling reaction and shows less contrast reduction and less AMT acutance than B-21. Extraction of the processed coating and analysis by high performance liquid chromatography verifies the stability of compound B-21 to processing solution in the absence of silver development.

TABLE III

| Element | Compound (mmoles/sq.m) | Contrast Ratio | AMT |
|---|---|---|---|
| Control | None | 1.00 | 91.4 |
| Comparison | 2 (0.05) | 0.59 | 94.1 |
| Invention | B-21 (0.05) | 0.54 | 94.9 |

Compound B-21

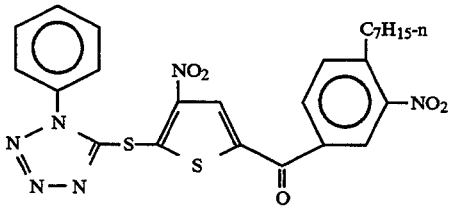

Multilayer negative films Samples 1 through 6, were obtained or prepared as described below:

Example 4

A multilayer photographic film element was prepared by coating a cellulose triacetate film support with the following layers in sequence (coverages are in grams per meter squared):

Sample 1

Layer 1 (Antihalation layer): black colloidal silver sol containing 0,151 g of silver, cyan dye material CD-1 (0.032), magenta dye material MD-1 (0.043), yellow dye material YD-1 (0.101) and gelatin (2.44) were contained in this layer.

Layer 2 (Lowest Sensitivity Red-sensitive layer): This layer comprised a blend of a red-sensitized, tabular grain silver iodobromide emulsion (1.3% iodide, 0.50 microns diameter by 0.08 microns thick) (0.463) and a red-sensitized tabular grain silver iodobromide emulsion (4.5% iodide, 1.00 microns diameter by 0.09 microns thick) (0.473). A cyan dye-forming coupler C-1 (0.54) and a BAR coupler BAR-1 (0.04) were incorporated in this layer. Gelatin was also included (1.78).

Layer 3 (Medium Sensitivity Red-sensitive layer): This layer comprised a red-sensitized, tabular grain, silver iodobromide emulsion (4.5% iodide, 1.31 diameter by 0.12 microns thick) (0.70). This layer also comprised a cyan dye-forming coupler C-1 (0.23), a cyan dye-forming masking coupler CM-1 (0.022), and DIR coupler D-1 (0.011). Gelatin (1.66) was included.

Layer 4 (Highest Sensitivity Red-sensitive layer): This layer comprised a red-sensitized, tabular grain, silver iodobromide emulsion (4.5% iodide, 2.70 diameter by 0.13 microns thick) (1.08). This layer also comprised a cyan dye-forming coupler C-1 (0.124), a cyan dye-forming masking coupler CM-1 (0.032), DIR coupler D-2 (0.05) and DIR coupler D-1 (0.024). Gelatin (1.36) was included.

Layer 5 (Interlayer): This layer comprised gelatin (1.29).

Layer 6 (Lowest Sensitivity Green-sensitive layer): This layer comprised a blend of a green-sensitized, tabular grain, silver iodobromide emulsion (1.3% iodide, 0.54 microns diameter by 0.08 microns thick) (0.602) and a green-sensitized, tabular grain, silver iodobromide emulsion (4.5% iodide, 1.03 microns diameter by 0.09 microns thick) (0.3). This layer also comprised a magenta dye-forming coupler A-3 (0.24) as Dispersion A. The layer also incorporated a masking coupler MM-1 (0.65) and gelatin (1.78).

Layer 7 (Medium Sensitivity Green-sensitive layer): This layer comprised a green-sensitized, tabular grain, silver iodobromide emulsion (4.5% iodide, 1.22 microns diameter by 0.11 microns thick) (0.97), a magenta dye-forming coupler A-3 (0.10) as Dispersion A, and a magenta dye-forming masking coupler MM-1 (0.064). This layer also incorporated DIR coupler D-1 (0.024) and gelatin (1.48).

Layer 8 (Highest Sensitivity Green-sensitive layer): This layer comprised a green-sensitized, tabular grain, silver iodobromide emulsion (4.5% iodide, 2.23 microns diameter by 0.13 microns thick) (0.97), a magenta dye-forming coupler A-3 (0.07) as Dispersion A and a magenta dye-forming masking coupler MM-1 (0.054). This layer also incorporated DIR coupler D-3 (0.01), masking coupler MM-1 (.054), DIR coupler D-4 (0.008) and gelatin (1.33).

Layer 9 (Yellow filter layer): This layer comprised yellow dye material YD-2 (0.11) and gelatin (1.33).

Layer 10 (Lowest Sensitivity Blue-sensitive layer): This layer comprised a blend of a blue-sensitized, tabular grain silver iodobromide emulsion (4.5% iodide, 1.02 micron diameter by 0.09 micron thick) (0.24) and a blue-sensitized, tabular grain, silver iodobromide emulsion (4.5% iodide, 1.38 microns diameter by 0.11 microns thick) (0.59). This layer incorporated a yellow dye-forming coupler Y-1 (0.70), yellow coupler Y-2 (0.28), DIR coupler D-5 (0.06), and BAR coupler BAR-1 (0.003), cyan coupler C-1 (0.016), and gelatin (2.60).

Layer 11 (Highest Sensitivity Blue-sensitive layer): This layer comprised a blue-sensitized, conventional 3-D grain, silver iodobromide emulsion (12% iodide, 1.0 micron) (0.22) and a blue-sensitized, tabular grain, silver iodobromide emulsion (4.5% iodide, 3.53 microns diameter by 0.14 microns thick) (0.57). This layer also incorporated yellow dye-forming coupler Y-1 (0.22), yellow coupler Y-2 (0,087), DIR D-5 (0,049), BAR-1 (0,005), cyan coupler C-1 (0.021), and gelatin (1.97).

Layer 12 (UV filtration layer): This layer comprised dye UV-1 (0.11), UV-2 (0.11), and unsensitized silver bromide Lippman emulsion (0.22). Gelatin was included (1.11).

Layer 13 (Protective layer): This layer comprised gelatin (0.92) and matte polymethylmethacrylate beads (0,054).

This film was hardened at coating with 1.75% by weight of total gelatin of hardener H-1. Surfactants, coating aids, oxidized developer scavengers, soluble absorber dyes and stabilizers were added to the various layers of this sample as is commonly practiced in the art.

Sample 2

Sample 2 was prepared in the same manner as Sample 1 except that DIR D-1 was removed from Layer 7, and DIRs D-3 and D-4 were removed from Layer 8 such that no inhibitor releasers were present in any of the green sensitive layers.

Sample 3

Sample 3 was prepared as Sample 2 except that A-3 (Dispersion A) in Layers 7 and 8 was replaced by A-3 (Dispersion B).

Sample 4

Sample 4 was prepared as Sample 1 except that A-3 (Dispersion A) in Layers 7 and 8 was replaced by an equimolar amount of A-14 (Dispersion C).

Sample 5

Sample 5 was prepared by removing the inhibitor releasers from Layers 7 and 8 in Sample 4 as described for Sample 2.

Sample 6

Sample 6 was prepared by replacing A-14 (Dispersion C) in Sample 5 with A-14 (Dispersion D).

Dispersion A=A-3 dispersed 1:1 (by weight) in dibutyl dodecanamide

Dispersion B=A-3 dispersed with an equimolar amount of blocked development inhibitor B-5 at 1:1 (by weight) in dibutyl dodecanamide Dispersion C=A-14 dispersed 1:1 (by weight) in dibutyl dodecanamide Dispersion D=A-14 dispersed with an equimolar amount of blocked development inhibitor B-5 at 1:1 (by weight) in dibutyl dodecanamide Samples of each multilayer film element were exposed with white light imagewise through a stepped density test object and subjected to the KODAK FLEXICOLOR TM (C41) process as described previously.

TABLE IV

| Sample | I/C | DIR | Blocked Inhibitor | γB | γG | γR |
|---|---|---|---|---|---|---|
| 1 | C | Yes | No | .718 | .730 | .568 |
| 2 | C | No | No | .948 | .804 | .589 |
| 3 | I | No | Yes | .719 | .687 | .573 |
| 4 | C | Yes | No | .727 | .707 | .561 |
| 5 | C | No | No | .949 | .799 | .596 |
| 6 | I | No | Yes | .723 | .713 | .594 |

The data in Table IV show that the released nucleophile from magenta image coupler A-3 provides a development inhibitor by interaction with a compound B-5.

Compounds utilized in the above multilayer example include:

C-1:

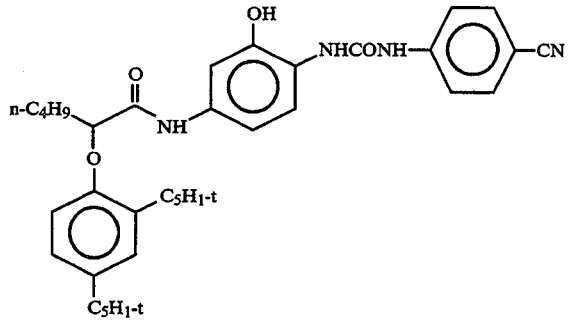

CM-1

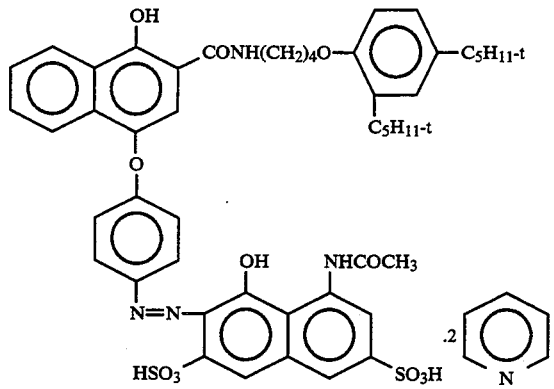

A-3

-continued
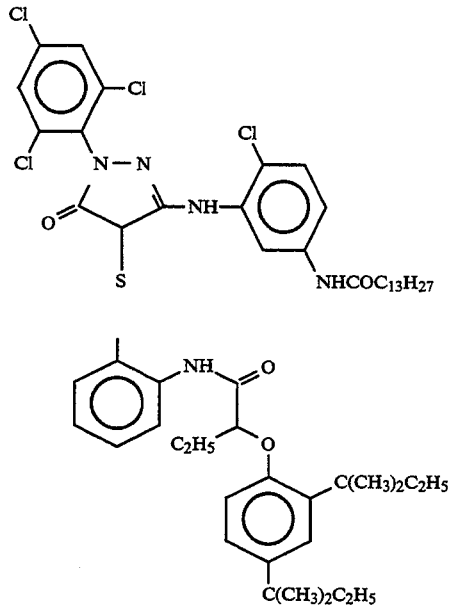
A-14
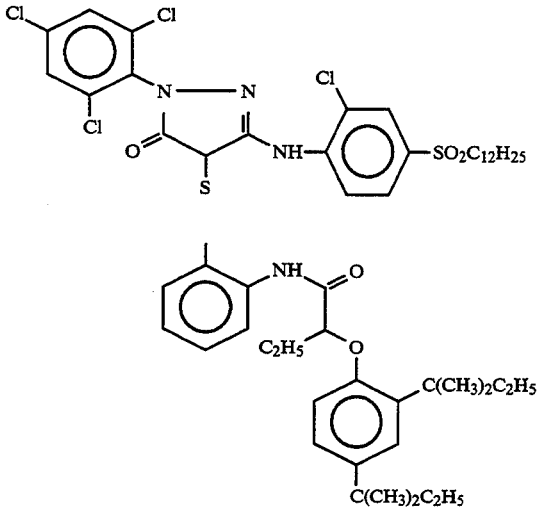
B-5
BAR-1
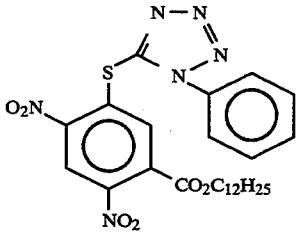
MD-1
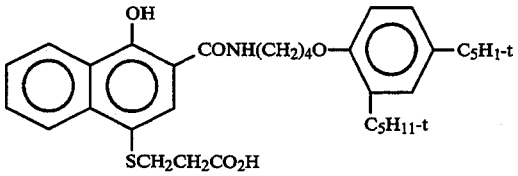
D-1

-continued
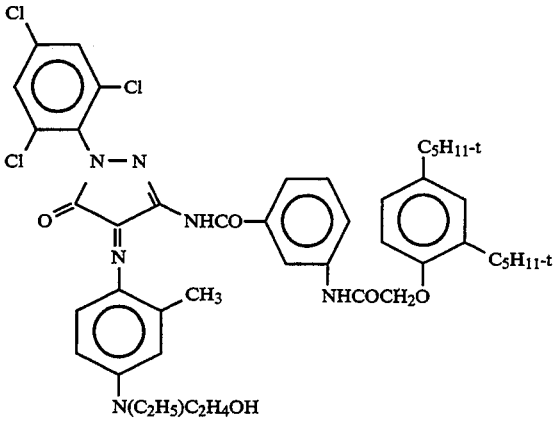
D-2
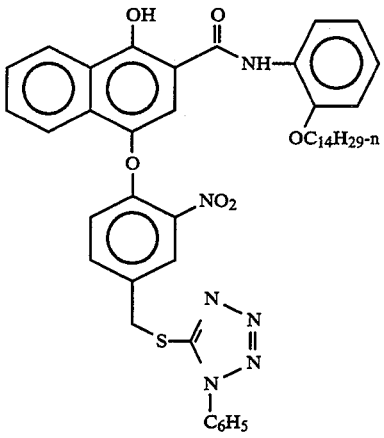
D-3:
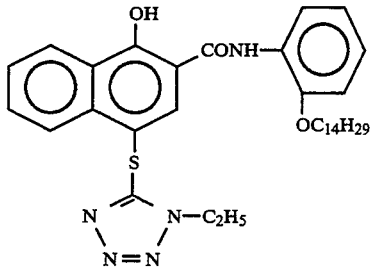
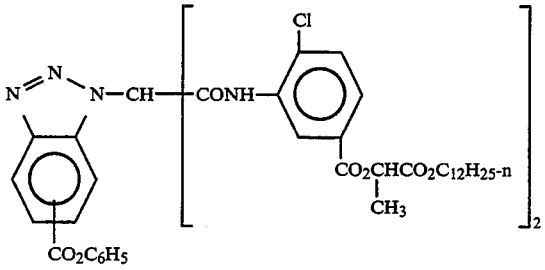
D-4:
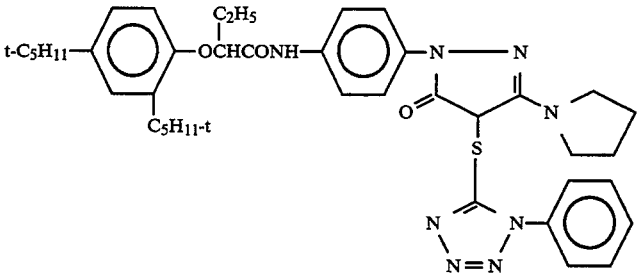
D-5
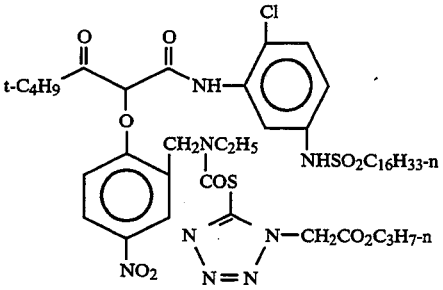
MM-1
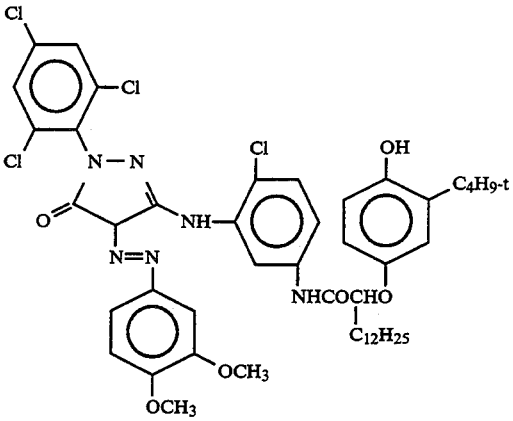
Y-1:
Y-2

-continued
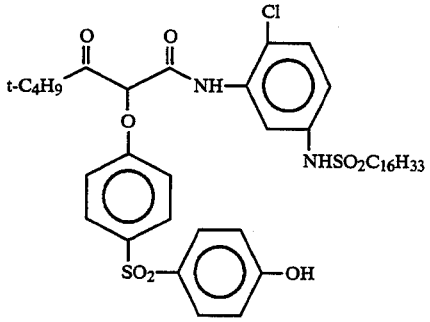
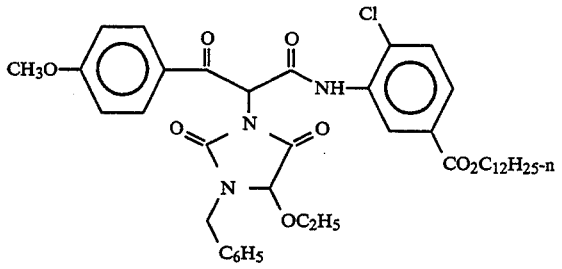
YD-1:
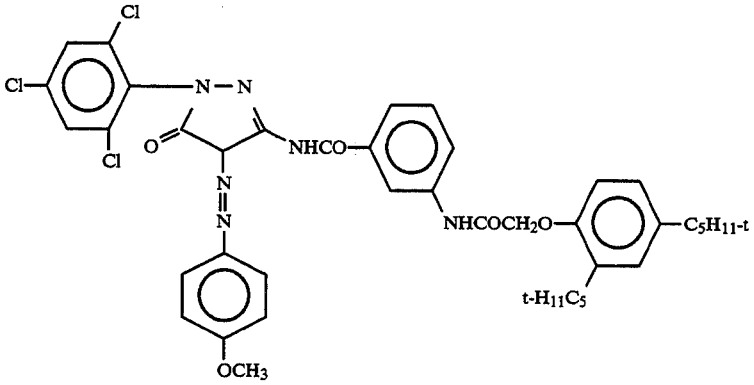
YD-2:
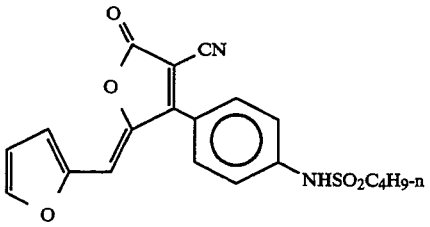
UV-1:
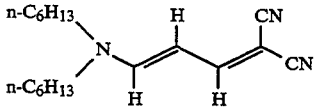
UV-2:
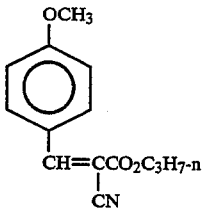
H-1:
$CH_2(SO_2CH{=}CH_2)_2$
CD-1:
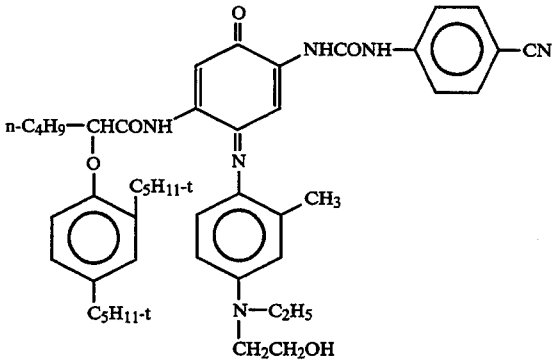
The invention has been described in detail with particular reference to preferred embodiments thereof, but it will be understood that variations and modifications can be effected within the spirit and scope of the invention.

What is claimed is:

1. A photographic element comprising a support bearing at least one silver halide emulsion layer, the element containing:

a) a release compound that provides, as a function of development, an imagewise distribution of a compound A that is photographically inert in the form in which it is released, compound A being a mobile nucleophile that is released from a carrier group as a function of silver halide development; and b) a uniform distribution in at least one of the layers of the element of a compound B, or a precursor of compound B that under photographic processing conditions provides a uniform distribution of compound B, both compound B and its precursor being photographically inert in the form in which it is contained in the layer, both compound B and its precursor further being a photographically active group that has its active site blocked by a group which is displaceable by compound A;

compounds A and B being such that, under photographic processing conditions, they interact to provide a photographically active group.

2. A photographic element of claim 1, wherein the compounds which provide compound A and compound B are in the same layer.

3. A photographic element of claim 1, wherein the compounds which provide compound A and compound B are in different layers.

4. A photographic element of claim 3, wherein one of compound A and compound B are in a layer free of silver halide emulsion.

5. A photographic element of claim 1 wherein compound B has the structural formula:

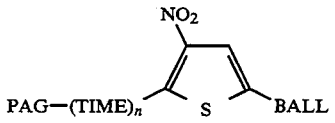

wherein:

BALL is a ballast group which renders the compound immobile in the layer in which it is coated;

TIME is a timing group;

n is 0 or 1; and

PAG is a development inhibitor.

6. A photographic element of claim 1, wherein the compound which provides compound A is selected from:

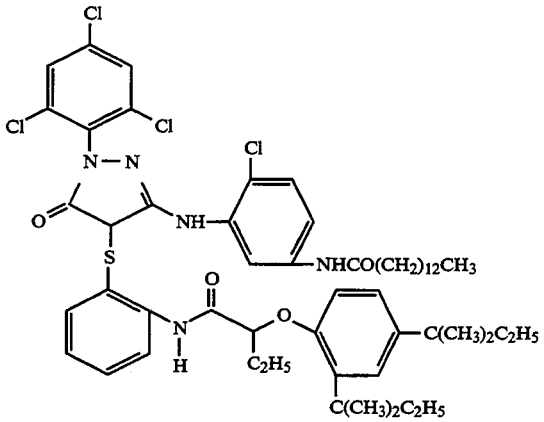

-continued

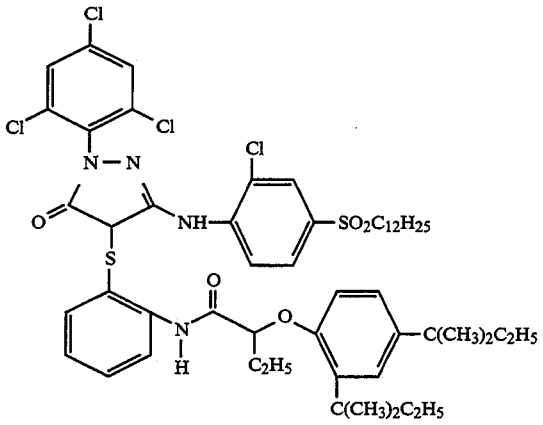

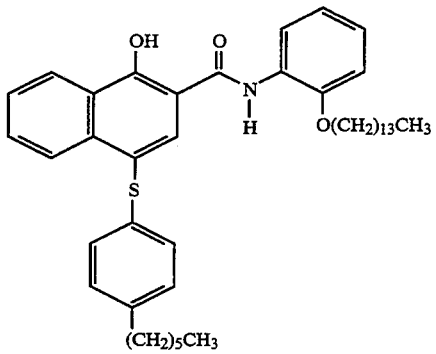

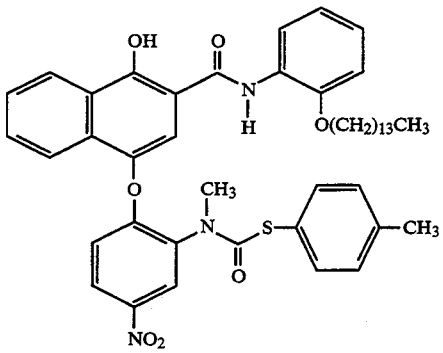

and the compound B is selected from

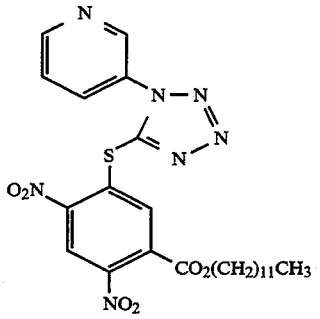

-continued

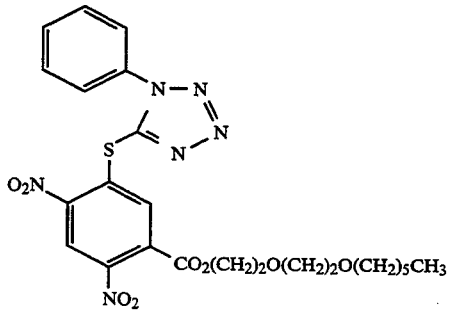

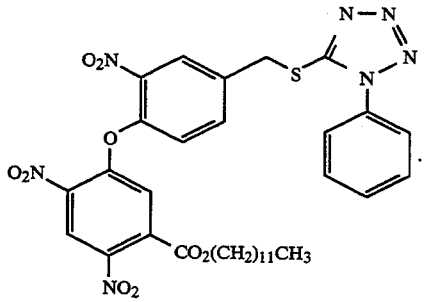

7. A photographic element of claim 1, wherein the photographically active group is selected from development inhibitors, development accelerators and bleach accelerators.

8. A photographic element of claim 1, wherein the nucleophile is an aryl, alkyl or heterocyclic thiol.

9. A photographic element of claim 1, wherein compound B has the structural formula:

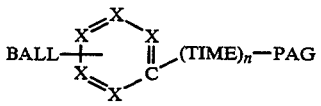

wherein:

X is N or C—R;

R is H or a monovalent substituent;

BALL is a ballast group which renders the compound immobile in the layer in which it is coated;

TIME is a timing group;

n is 0, 1 or 2; and

PAG is a photographically active group.

10. A photographic element of claim 1, wherein compound B has the structural formula:

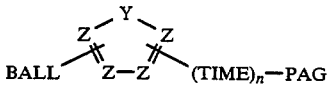

wherein:

Y is O, S, or N—R;

Z is N or C—R;

R is H or a monovalent substituent;

BALL is a ballast group which renders the compound immobile in the layer in which it is coated;

TIME is a timing group;

n is 0, 1, or 2; and

PAG is a photographically useful group.

11. A photographic element of claim 1, wherein the compound which provides compound A is a pyrazolone coupler that has a thiol nucleophile in its coupling position.

12. A photographic element of claim 1, wherein compound B has the structural formula:

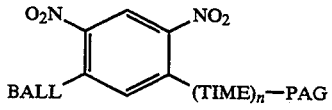

wherein:

BALL is a ballast group which renders the compound immobile in the layer in which it is coated;

TIME is a timing group;

n is 0 or 1;

PAG is a development inhibitor.

13. A photographic element comprising a support bearing at least one silver halide emulsion layer, the element containing:

a) a release compound that provides, as a function of development, an imagewise distribution of a compound A that is photographically inert in the form in which it is released; and b) a uniform distribution in at least one of the layers of the element of a compound B, or a precursor of compound B that under photographic processing conditions provides a uniform distribution of compound B, each of compound B and its precursor being photographically inert in the form in which it is contained in the layer;

compounds A and B being such that, under photographic processing conditions, they interact to provide a photographically active group;

at least one of compounds A and B providing a nucleophile, other than an amine or oxygen nucleophile, which interacts with the other of the compounds to provide the photographically active compound.

* * * * *